United States Patent [19]

Doyama

[11] 4,258,638

[45] Mar. 31, 1981

[54] ELECTROMAGNETIC CONTROL DEVICE FOR SEWING MACHINE

[75] Inventor: Umeo Doyama, Tokyo, Japan

[73] Assignee: Riccar Company, Ltd., Tokyo, Japan

[21] Appl. No.: 36,338

[22] Filed: May 7, 1979

[51] Int. Cl.[3] ..... D05B 3/02

[52] U.S. Cl. ..... 112/158 E

[58] Field of Search ..... 112/158 E, 220, 275, 112/277, 121.11, 121.12; 310/156

[56] References Cited

U.S. PATENT DOCUMENTS

| | | | |
|---|---|---|---|
| 3,978,356 | 8/1976 | Spiesberger | 310/156 |
| 4,103,632 | 8/1978 | Bowles | 112/158 E |
| 4,143,606 | 3/1979 | Herr et al. | 112/158 E |

FOREIGN PATENT DOCUMENTS

| | | | |
|---|---|---|---|
| 2821552 | 11/1978 | Fed. Rep. of Germany | 112/158 E |

*Primary Examiner*—Peter P. Nerbun

*Attorney, Agent, or Firm*—Sigalos & Levine

[57] ABSTRACT

In a sewing machine having a signal generator for producing a desired stitch pattern signal and a stitch forming mechanism actuated by said signal for forming said desired pattern, a device for receiving said signal and controlling said mechanism comprising an electromagnetic driver having a rotor shaft and a stator, at least one pair of coils mounted on said stator for receiving said desired stitch pattern signal and generating corresponding magnetic fields, a plurality of magnets attached to the periphery of said rotor in alternating polarity for interacting with said generated magnetic fields to angularly position said rotor in accordance with said stitch pattern signal, and means coupling said rotor shaft to said stitch forming mechanism to form said selected stitch pattern.

8 Claims, 4 Drawing Figures

FIG. 1
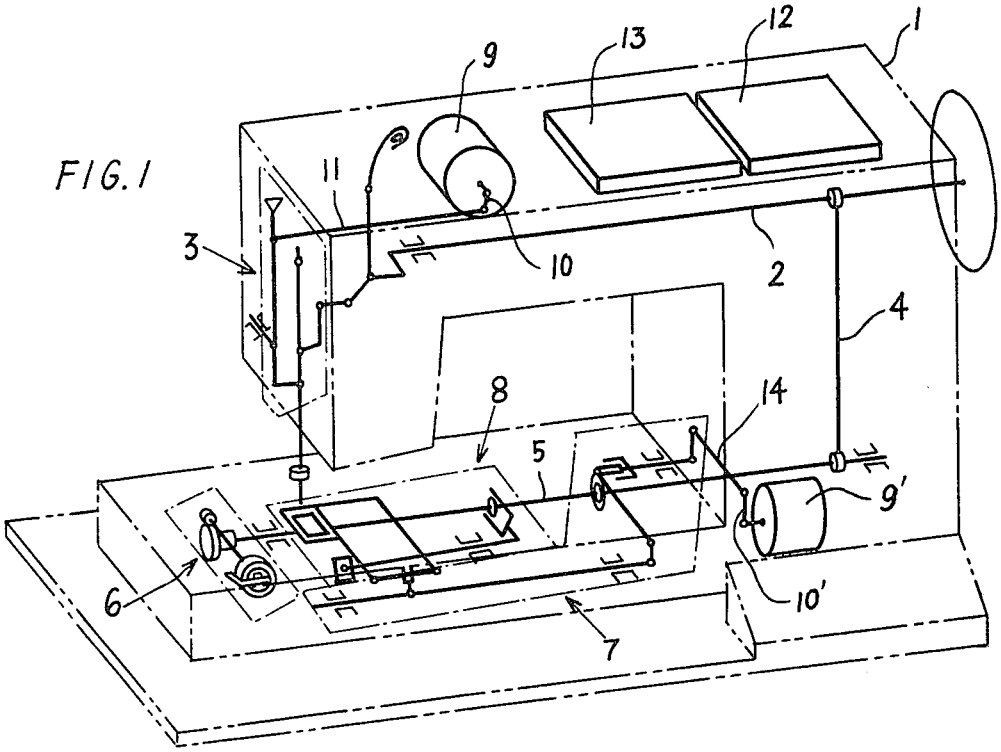
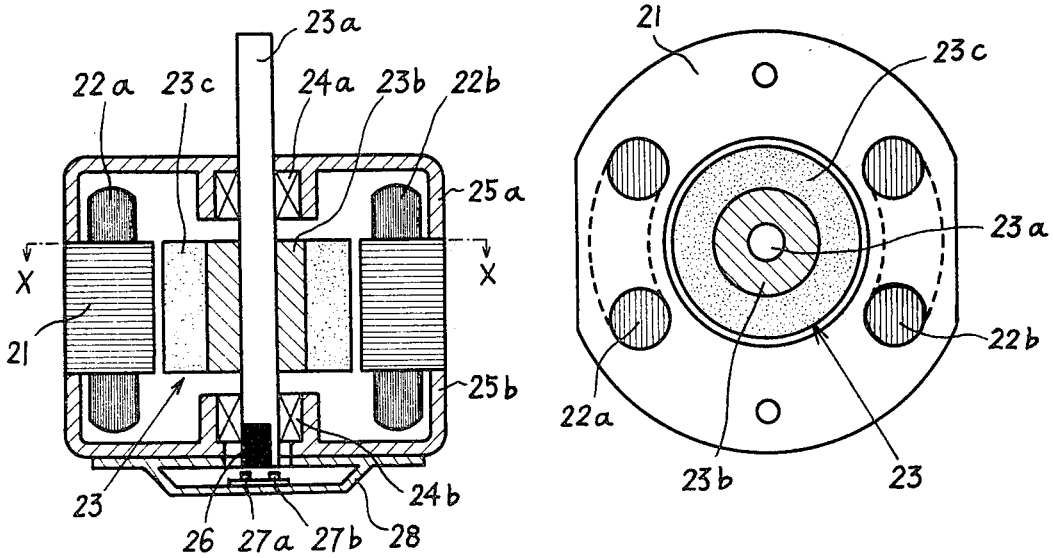
FIG. 2

FIG. 3
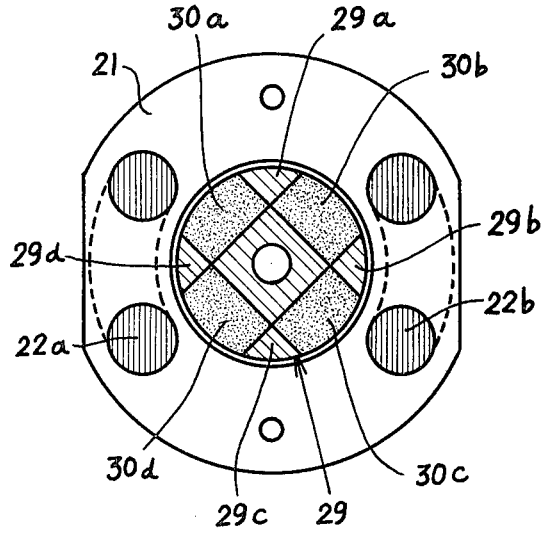
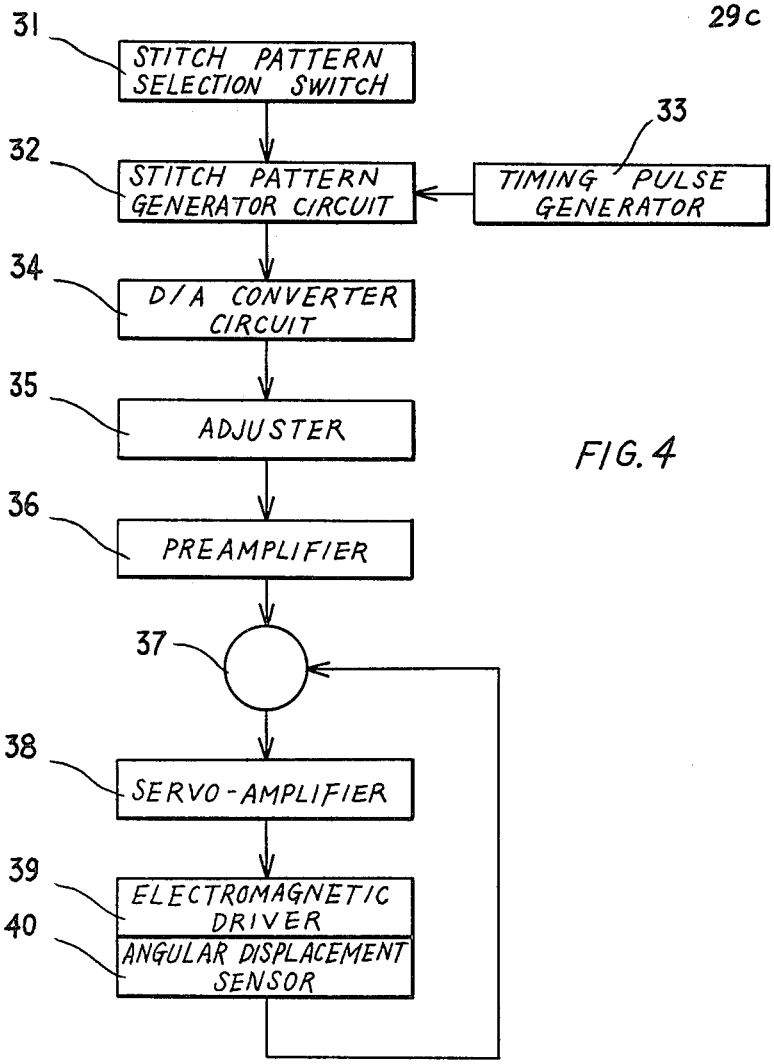
FIG. 4

ELECTROMAGNETIC CONTROL DEVICE FOR SEWING MACHINE

BACKGROUND OF THE INVENTION

Heretofore, for the driving mechanism of a needle bar unit and work feed unit for stitch pattern forming in an electronic sewing machine, either a linear actuator controlled by a servo-amplifier or stepping motor (pulse motor) controlled by a drive circuit have been utilized. In said linear actuator, the center leg is inserted in said actuator in parallel with permanent magnets which are fixed to opposite sides of the casing facing each other, so that the magnetic path of said permanent magnets passes through said casing and said actuator center leg. A bobbin coil is mounted on the center leg so loosely as to be slidable on said leg back and forth. A protruding lug is integrally molded with the above coil and it is coupled to the rotor axis of a potentiometer contact through the medium of a lever which is pivotally adjustable on both the lug and center axis of the potentiometer by a screw. When an analog DC potential representing a command signal corresponding the desired stitch pattern information is applied to this coil through the output of said servo-amplifier, the said bobbin coil is driven forward or backward in proportion to the magnitude of the stitch pattern signal potential and polarity. This movement is transmitted to the potentiometer through said lever which is fixed on the center axis of potentiometer. The center axis of said potentiometer is rotatably driven by said lever. As a predetermined potential is applied to the two terminals of said potentiometer from a stabilized DC source, the angle displacement of the center axis can be detected by the potential of the center contact. This potential is then fed back to the servo-amplifier for summation with the inverse phase of the input command signal potential so that the position servo functions of the needle bar and work feed unit are maintained. In addition, it can be corrected by an added potential derived from differentiating the detected signal.

However, on this linear actuator, if the electromotive force derived from the current through the coils, which are inserted in a magnetic field generated by opposing permanent magnets, is required to be increased, it is necessary to either increase the number of coil turns on the bobbin, increase the driving current or provide a larger volume of permanent magnet or magnetic material with a higher coercive force, but all of which are expensive and make this device higher in cost. Also, when a larger current flows, it causes more heat dissipation in the unit which raises the internal temperature to an undesirably high value. Further, the potentiometer is inconveniently located for outside adjustment of the unit.

On the other hand, when a stepping motor is used, it is shifted by a digital step angle related to the stitch pattern signal and the smallest step angle of shift is limited by the small size stepping motor which is obliged to be used because of the limited space in home use sewing machines and it cannot be adjusted to follow the continuous pattern of the needle bight and work feed required by the stitch pattern generator.

SUMMARY OF THE INVENTION

In order to overcome above shortcomings found in the prior art, this invention enables the use of a low cost electromagnetic control device with a strong driving force by using a new and unique electromagnetic driver and servo-amplifier.

DESCRIPTION OF THE DRAWINGS

The subject matter which is regarded as the invention is particularly pointed out and distinctly claimed in the concluding portion of this specification. The invention itself, however, both as to its organization and method of operation thereof may best be understood by reference to the following description taken in connection with the accompanying drawings in which:

FIG. 1 shows a skeleton diagram of the electromagnetic driver of this invention as applied in a sewing machine, FIG. 2 illustrates the electromagnetic driving unit of this invention in which FIG. 2(A) is a longitudinal sectional view and FIG. 2(B) is a cross-sectional view taken along the lines X—X, FIG. 3 illustrates another modified embodiment of this invention similar to FIG. 2, and FIG. 4 illustrates a circuit block diagram of the electromagnetic device embodied in this invention.

DETAILED DESCRIPTION OF THE INVENTION

This invention is concerned with an electromagnetic control device which controls the needle bar unit and work feed unit for pattern stitch forming in an electronic sewing machine.

FIG. 1 of the attached drawing is a skeleton diagram of a sewing machine linkage which is coupled with two unique and novel electromagnetic drivers of this invention. As shown in phantom outline in FIG. 1, a sewing machine casing 1 includes a sewing machine motor (not shown) which drives upper arm shaft 2 and moves the needle up and down and at the same time drives lower rocker shaft 5 and rotary hook 6 through timing belt 4 in synchronous timing with the up and down stroke of the needle thereby coupling the motion of work feed forward unit 7 with work feed rock motion unit 8.

Electromagnetic driver 9 drives needle bar unit 3 for needle bight through link 10 which is connected through gate drive arm 11 at the top of needle bar unit 3 and is pivoted at the middle of the needle bar. When the needle position signal, following the selection by appropriate switch (not shown) of switch pattern generator 12, is supplied from the stitch pattern signal generator 12 to servo-amplifier 13 in timing with a revolution of sewing machine shafts 2 and 5 by a needle position synchronizing signal (timing signal generator 33 in FIG. 4), the servo-amplifier 13 determines the needle position by controlling needle bar unit 3. Said servo-amplifier 13 actually includes two servo-amplifiers, one of which is used to control the needle position as indicated above and the other to control the work feed position.

On the other hand, electromagnetic driver 9' is coupled to work feed forward unit 7 through rod 14 and, in the same manner as the needle position selection is controlled, the work feed signal contained in the stitch pattern output signal as selected through the stitch pattern forming generator 12 is supplied to servo-amplifier 13 in synchronization with the timing of a work feed synchronous signal which determine the work feed position. As stated above, one stitch of the needle is executed by linkage motion with a revolution of the sewing machine shafts 2 and 5 in cooperation with every part of the stitch pattern forming mechanism.

Pattern stitching is performed by successive revolutions of sewing machine shafts 2 and 5 and proceeds continuously.

FIG. 2 illustrates electromagnetic drive 9 (or 9') and FIG. 2(A) is a longitudinal sectional view and FIG. 2(B) is an X—X cross-sectional view. Enameled wire or the like is wound in the same direction to form at least one pair of coils 22*a*, 22*b* which are connected electrically in parallel on stator 21. Stator 21 is constructed of laminated silicon steel sheets. The center axis of stator 21 is hollowed to form a circular bore. The center shaft 23*a* of rotor 23 is supported in said circular bore in fittings on upper journal bearing 24*a* of upper case 25*a* and lower journal bearing 24*b* of lower case 25*b*. Magnetic body 23*c* is fixed on the center axis 23*a* of rotor 23 with non-magnetic material 23*b* interposed therebetween and the surface of which is opposite the inner surface of stator 21 with a slight gap separating the two.

A small magnetic piece 26 is fixed on one end portion of center axis rotor shaft 23*a*. Two magnetic resistance elements 27*a* and 27*b* are attached on a plate and this assembly is fixed on the cover plate 28 leaving a small gap between said small magnetic piece 26 and the magnetic resistance elements 27*a* and 27*b* when the cover plate 28 is attached to lower case 25*b* by a screw or other means.

For this embodiment, ferrite is used as the magnetic material of magnet 23*c* affixed to rotor 23. On the peripheral surface of this magnet, different magnetic polarities such as 4 alternating poles of N-pole, S-pole, N-pole and S-pole are magnetically formed to develop a uniform magnetic flux about the surface and these poles are separated by non-magnetic portions.

The output of servo-amplifier 13 (cf. FIG. 1) is connected to one coil pair 22*a*, and 22*b* which are wound in the same direction. When a plus or minus DC potential is generated by servo-amplifier 13, a plus or minus DC current is caused to flow in coils 22*a* and 22*b* in the proper direction. Even a small current flowing in one pair coil 22*a* and 22*b* causes a magnetic field to be generated which forces opposed rotor 23 to seek a balanced state. Consequently, magnet 23*c* of rotor 23 which is magnetized with alternating polarity induces repulsive and attractive forces with said generated field and causes said rotor 23 to rest steadily in an equilibrium position. Thus, when the stitch pattern signal is applied to servo-amplifier 13, a magnetic field is generated in said electromagnetic driver in polarity and magnitude in proportion to the polarity and the magnitude of this signal current flowing in one coil pair. The angular position of rotor 23 is shifted by the action of the magnet in a counter-clockwise or clockwise direction according to the repulsive or attractive force generated.

During the positioning of rotor 23 as indicated above, by the angle displacement of center axis 23*a*, the relative angle of the magnetic resistance elements 27*a* and 27*b* to opposed said small magnet 26 fixed on the lower portion of center axis 23*b* is displaced or changed. The small magnet 26 and two magnetic resistance elements 27*a*, 27*b* are constituted as a non-contacting potentiometer and when a stabilized direct current potential is applied on both terminals of the resistance, a sensor current is detected in the middle point of the potentiometer and shows the displacement angle of small magnet 26. This signal is then fed back to the input line of servo-amplifier 13 in reverse phase and holds the rotor stationary in the angle specified by stitch pattern signal.

In this method, magnetic brake forces appear between the magnetic field induced by coils 22*a*, 22*b* and the magnetic field of magnet 23*c* of rotor 23 and, therefore, a velocity servo function is retained sufficiently so that it is not necessary to supplement the control signal from servo-amplifier 13 with a correction circuit such as differential circuit in servo-amplifier 13 or a compensating generator coil inserted in or linked with the electromagnetic driver.

Further, the angular sensor of center axis 23*a* of rotor 23 for magnetic drivers 9 or 9' is formed of the combined elements of small magnet 26 and magnetic resistance elements 27*a* and 27*b* in this embodiment. However, if desired, a Hall element or Hall element IC can be also used as a potentiometer located opposite the small magnet piece 26 wherein the magnetic field of magnet 26 varies the resistance of the integrated circuit or, alternatively, a slide contact arm fixed in the lowest end of center axis 23*a* could also be used as the center point of a wired potentiometer.

FIG. 3 shows another embodiment of electromagnetic driver 9 (9') on which magnets 30*a*, 30*b*, 30*c* and 30*d* attaching on rotor are separated by 4 pieces of non-magnetic material 29*a*, 29*b*, 29*c* and 29*d* and the outer peripheral surface is magnetized alternately such as N, S, N and S poles. Adjacent magnetic poles are so separated as to make magnetic efficiency and coersive force increase which increases the driving force with the displacement angle. A longitudinal sectional view of FIG. 3 is the same as FIG. 2(A) and the function is also the same.

FIG. 4 shows a block diagram of the electric circuit which explains the function of the electromagnetic control device. As the needle position circuit and work feed circuit are essentially the same circuits driven by the stitch pattern generation circuit 12, only the needle position circuit is illustrated.

At first, when the operator selects and presses the stitch pattern selection switch 31 for the desired stitch pattern (which is displayed on the surface of the sewing machine body), the selected stitch pattern signal is generated by stitch pattern generator circuit 32 (cf. 12 of FIG. 1) in synchronism with the revolution of sewing machine shafts 2 and 5 by a synchronous signal from timing pulse generator 33. The needle position signal supplied to D/A converter circuit 34 is the needle position synchronous signal from stitch pattern generator circuit 32. The work feed signal is also supplied in the same way to a D/A converter (not shown) for the work feed unit. The stitch pattern signal is supplied as a binary digital code which is converted to an analog potential signal by D/A converter 34 and modified by adjuster 35 such as a needle position adjustor to be set to the proper signal level for preamplifier 36. After the proper level is set, this signal is supplied through summing point 37 to servo-amplifier 38. The electromagnetic driver 39 (corresponding to unit 9 of FIG. 1) is directly coupled to servo-amplifier 38 (corresponding to unit 13 of FIG. 1) and displaced in angular position proportional to the above needle position signal.

Concurrently, by the built-in sensor composed of the angular displacement potentiometer 40 (corresponding to the potentiometer composed of small magnet 26 and magnet resistance elements 27*a*, 27*b* in FIG. 2(A)), a signal is generated representing displacement angle which is summed with the input analog signal in reverse phase at summing point 37 through a feedback line. The needle bar unit 3 is connected to and driven by electromagnetic driver 39 (cf. 9 of FIG. 1) and is caused to rest in the precise position indicated by the needle position signal supplied to D/A converter 34.

The work feed mechanism is driven in the same manner. The work feed electromagnetic driver 9' (cf. FIG. 1) drives the work feed forward unit 7 by rod 14 through link 10'. However, it is more convenient for effective use of angular displacement forces if such angular displacement drive force is directly coupled to the work feed forward mechanism 7.

As explained in detail by this invention, an electromagnetic driver drives the needle bar unit 3 and work feed units 7 and 8. The coil of the prior art is wound on a synthetic material bobbin and is slidably mounted on the linear actuator. The coil of the present invention is wound on a stator which is constructed of laminated silicon steel sheets (or of a pure iron block) and has a fairly large radiating surface, so that a larger sectional area of wire with a greater number of turns can be wound thereon. Consequently, a fairly strong magnetic field applied to the driver can be attained in comparison with the prior art because a larger current can flow.

Moreover, when the upper or lower case is tightly attached to the sewing machine body, it will have an increasing heat radiating effect, and large angle displacement can be derived by exceeding the normal heat capacity of the driver volume because of the heat dissipation and such heat can be expected to be endured for a longer time of operation. The device is extremely durable and it is not necessary to add a built-in generator coil or velocity servo circuit as a differential circuit correction, because the electromagnetic driver itself retains the ability of a velocity servo function. As the volume or size of the angular position sensor can be decreased, it can be located in a smaller space with direct attachment to the driver body. As the needle bight and work feed can be adjusted by the analog potential circuit in comparison with the digital control of the stepping motor in the prior art, it can be seen that the construction becomes simpler and the cost is decreased by utilizing easily available materials.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. In a sewing machine having a signal generator for producing a desired stitch pattern signal and a stitch forming mechanism actuated by said signal for forming said desired pattern, a device for receiving said signal and controlling said mechanism comprising:

a. an electromagnetic analog driver having a rotor shaft and a stator, b. at least one pair of coils mounted on said stator for receiving said desired stitch pattern signal and generating corresponding magnetic fields, c. a plurality of magnets attached to the periphery of said rotor in alternating polarity for interacting with said generated magnetic fields to angularly position said rotor in accordance with said stitch pattern signal, and d. means coupling said rotor shaft to said stitch forming mechanism to form said selected stitch pattern.

2. A sewing machine as in claim 1 wherein said stitch forming mechanism comprises:

a. a needle bar unit for positioning said needle, and b. a work feed unit for positioning said work under said needle to produce said desired stitch pattern.

3. A sewing machine as in claim 2 wherein said signal generator comprises:

a. means for generating a needle position synchronizing signal, and b. means for generating a work feed synchronizing signal.

4. A sewing machine as in claim 3 further including:

a. a first electromagnetic analog driver having its input coupled to said signal generator for receiving said needle position synchronizing signal and its output to drive said needle bar unit, and b. a second electromagnetic analog driver having its input coupled to said signal generator for receiving said work feed synchronizing signal and its output coupled to drive said work feed unit.

5. A sewing machine as in claim 4 further including:

a. a sensor attached to said rotor of said first and second electromagnetic drivers to generate an analog signal representing the angular position of said rotor, and b. means coupling said signal representing said angular position of said rotor to the input of said first and second driver respectively in reverse phase as a feedback signal to properly position said rotors.

6. A sewing machine as in claim 5 further including a non-magnetic material separating said magnets of alternating polarity attached to said rotor of said driver.

7. A sewing machine as in claim 6 further including a servo-amplifier for providing an analog signal for said electromagnetic drivers.

8. A sewing machine as in claim 7 further including:

a. a D/A converter for receiving said stitch pattern signal in digital form and converting it to an analog form, and b. means coupling said analog signal form to said servo-amplifier.

* * * * *